US009279327B2

(12) United States Patent
Shepherd

(10) Patent No.: US 9,279,327 B2
(45) Date of Patent: Mar. 8, 2016

(54) GAS TURBINE ENGINE COMPRISING A TENSION STUD

(75) Inventor: Andrew Shepherd, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 487 days.

(21) Appl. No.: 13/813,272

(22) PCT Filed: Aug. 2, 2011

(86) PCT No.: PCT/EP2011/063288

§ 371 (c)(1), (2), (4) Date: Jan. 30, 2013

(87) PCT Pub. No.: WO2012/016981

PCT Pub. Date: Feb. 9, 2012

(65) Prior Publication Data

US 2013/0125559 A1 May 23, 2013

(30) Foreign Application Priority Data

Aug. 3, 2010 (EP) ..... 10171715

(51) Int. Cl.
*F01D 5/06* (2006.01)

(52) U.S. Cl.
CPC ..... *F01D 5/066* (2013.01); *F05D 2250/292* (2013.01); *F05D 2260/941* (2013.01)

(58) Field of Classification Search
CPC ..... F01D 5/066; F01D 5/025; F01D 5/026; F01D 5/06; F01D 5/02
USPC ..... 416/198 A, 200 A; 415/198.1, 199.4, 415/199.5
See application file for complete search history.

(56) References Cited

U.S. PATENT DOCUMENTS

| | | | | |
|---|---|---|---|---|
| 3,612,628 | A | 10/1971 | Steele | |
| 4,060,337 | A * | 11/1977 | Bell, III | 416/186 R |
| 6,499,969 | B1 * | 12/2002 | Tombers et al. | 416/204 A |

FOREIGN PATENT DOCUMENTS

| | | | |
|---|---|---|---|
| EP | 0742634 | A2 | 11/1996 |
| GB | 898163 | A | 6/1962 |
| GB | 2452932 | A | 3/2009 |
| WO | WO 2004076821 | A1 | 9/2004 |

* cited by examiner

*Primary Examiner* — Richard Edgar

(57) ABSTRACT

A gas turbine engine including a rotor is disclosed. The rotor includes a stud extending along an axis, rotating elements of a first section, and rotating elements of a second section. The stud includes a first and second external end, the first external end adapted to engage a first pre-load nut or a shaft and the second external end adapted to engage a second pre-load nut or a shaft such that the set of rotating elements are secured. Thus stud includes a first shank connected to the first external end and a second shank connected to the second external end. The first shank is located in the first section and has a first diameter. The second shank is located in the second section and has a second diameter which is greater than the first diameter.

9 Claims, 6 Drawing Sheets

GAS TURBINE ENGINE COMPRISING A TENSION STUD

FIELD OF THE INVENTION

This invention relates particularly but not exclusively to gas turbines or turbomachines with axial shaft mounted compressor and power turbine blades.

BACKGROUND OF THE INVENTION

In gas turbines engines, a number of discs including radially extending blades which are inserted to the discs are provided to form a rotor. There are sets of discs for compressor blades and sets of discs for turbine blades. The respective sets of discs are retained by a turbine nut and a compressor nut respectively applied to one or two tension studs, the nuts and the studs are used to apply a preload to tension the arrangement to ensure that all rotating parts are secure during operation of the turbine.

In current turbines, the rotor may be held together by a pair of tension studs. In the following one possible way how to assemble a compressor and a turbine is explained in a simplified manner. A first threaded end of the first stud may engage into a threaded bore in a shaft element of the rotor. A compressor disc then may be pushed axially into position and locked to the shaft element. Further compressor discs may additionally be pushed into position. Finally a threaded compressor nut may be engaged to a second threaded end of the first stud and tightened such that all compressor discs are secured to each other and the shaft element. For the turbine discs, a first threaded end of the second stud may engage in a threaded bore of the other end of the shaft element. Then turbine discs may be pushed axially into position from the opposite side and a threaded turbine nut may be applied to a second threaded end of the second stud and tightened such that all turbine discs may be locked to the shaft element.

A prior art gas turbine arrangement is known from UK patent application GB 2452932 A and is also shown in prior art FIG. 1 which is a longitudinal section along an axis of a bladed rotor of a gas turbine, the axis being an axis of rotation. It comprises—left to right looking at the figures—, an axially extending compressor stud, a compressor nut, an inlet shaft, a set of compressor discs, an intermediate shaft, a turbine stud, a set of turbine discs and a turbine nut. In FIG. 1 shows different stages of assembly of the gas turbine arrangement. Please note that the order of assembly may be different to the sequence as explained in the following.

In FIG. 1A, a threaded compressor stud is rotated into threaded engagement into a threaded bore in an intermediate shaft and compressor discs are slid over the compressor stud from left to right during assembly. An inlet shaft is then mounted onto the compressor stud and a compressor pre-load nut threaded onto the compressor stud end. A hydraulic tool is applied to stretch the stud and the compressor nut is tightened to engage the inlet shaft before the tool is removed. This retains the pre-load applied to the compressor stud. The stretch required may be affected by relative thermal and mechanical expansion and contraction at different operating conditions of the stud and the clamped components.

FIG. 1B shows a turbine stud threaded into another axial end of the intermediate shaft. Then—not yet shown in FIG. 1B—the next stage is to assemble the turbine discs onto the turbine stud from right to left with a turbine nut being threaded onto the other end of the turbine stud, as shown in FIG. 1C. The hydraulic tool is applied to stretch the turbine stud and the nut is tightened to retain the pre-load when the tool is removed.

It will be appreciated that this is a complicated arrangement which requires careful machining and assembly for adequate operation and a long service life. The material of the stud, the dimensions of the stud, the amount of stretch of the stud, etc. has to be considered to ensure sufficient rotating load at all operating conditions of the gas turbine engine. In particular, the threaded connections and the studs may experience stress. It has to be noted that with "load" a clamping force is meant applied by the stud to the discs.

From patent GB 898153 a shaft is known that consists of two pieces that are assembled together via a thread. Both pieces have different diameters. From WO 2004/076821 A1 an air thrust bearing is disclosed in a gas turbine engine having a single piece shaft comprising of two sections having a slightly different diameter.

In EP 0742634 A2 a compound shaft is disclosed. A first stiff shaft is connected to a second stiff shaft via a flexible disk shaft.

According to US patent U.S. Pat. No. 3,612,628 a bolt comprising of two sections can be inserted into a hollow single piece rotating shaft of a bearing.

It is a goal of the invention to reduce stress and fatigue of the stud and the threads.

SUMMARY OF THE INVENTION

The present invention seeks to mitigate these drawbacks.

This objective is achieved by the independent claims. The dependent claims describe advantageous developments and modifications of the invention.

In accordance with the invention there is provided a gas turbine engine comprising a rotor rotatably mounted in a body about an axis, an axial direction being defined along the axis in downstream direction of a main fluid path of the gas turbine engine i.e. in direction from a compressor section to a turbine section, the rotor comprising a stud—a tension stud—, a first set of rotating elements of a first section of the gas turbine engine, the first section being a compressor section or at least an upstream section of a compressor section of the gas turbine engine, and a second set of rotating elements of a second section, particularly a turbine section or a further compressor section, of the gas turbine engine, the first and second set of rotating elements particularly being discs—particularly compressor discs to hold compressor blades and/or turbine discs to hold turbine blades—and/or shafts. The stud extends along the axis and comprises a first external end and a second external end, the first external end being adapted to engage a first pre-load nut or one of the shafts and the second external end being adapted to engage a second pre-load nut or one of the shafts such that the set of rotating elements are secured—e.g. clamped—, the stud further comprises, a first shank connected to the first external end and a second shank connected to the second external end. The first shank is located in the first section and has a first diameter. The second shank is located in the second section and has a second diameter greater than the first diameter.

Particularly the first diameter is adapted for temperatures occurring in the first section during operation of the gas turbine engine, and the second diameter is adapted for temperatures occurring in the second section during operation of the gas turbine engine.

The axis is particularly an axis of rotation of the gas turbine engine and is directed in downstream direction of a main fluid path from an inlet of the gas turbine engine in direction of an outlet. In other words, the axial direction may be defined as corresponding to a downstream fluid flow of a working fluid through the first section and/or the second section during operation of the gas turbine engine. A radial direction may be defined a direction starting from the axis and being located in a plane perpendicular to the axis.

The stud may particularly be a single or monolithic stud. It may be build from one piece. It may be a unitary constructed stud.

The first shank may be connected via an intermediate part to the second shank. Optionally this intermediate part may be implemented as a shoulder that may be present between the first shank and the second shank such that the first shank may be located between the first external end and the shoulder and the second shank may be located between the shoulder and the second external end. The shoulder may provide for example a surface—particularly cylindrical—to which a shaft or a disc can be connected which may restrict vibration of the stud by contacting the inner surface of a disc opposing the shoulder if the stud vibrates. For example a vibration damper may be located between an outer shoulder surface and an opposing disc.

With a shaft or shaft element a part of the rotor is meant that rotates around the axis and may be connected to the discs. Possibly a shaft may be connected or at least in contact with the shoulder and/or the first external end and/or the second external end. A shaft may also hold blades but may have a larger axial length than a disc.

The diameters may be diameters of the shanks at a specific axial position—e.g. in the middle of the specific shank—or may be an average value for diameters of the specific shank. The diameters will be determined in a plane perpendicular to the axis.

"Adapted for temperatures" means that specifics of a material of the shanks and of the temperature gradient at axial positions on the stud are observed. A gas turbine engine according to the invention will operate with a temperature gradient in the stud, in which the temperatures in the first region will be less than the temperatures in the second region.

Particularly the shape of the first shank and the shape of the second shank are adapted for temperatures occurring in the area of the first shank and the second shank respectively during operation.

The invention is particularly advantageous that a required amount of stretch can be achieved on the stud with a reduced pre-load. This is because the thinner section of the shank allows to have a smaller load to achieve the same amount of stretch i.e. a 10% reduction in cross sectional area will give the same stretch with a 10% lower load. This means that the maximum load transmitted through stud threads for connection to the shafts or discs is reduced, and the fatigue life of the threads is increased.

With "load" a clamping force is meant applied by the stud or the pre-load nuts to the discs. Thus this force may be experienced at the first pre-load nut in axial downstream direction and furthermore may be experienced at the second pre-load nut in axial upstream direction.

The stud may have several different diameters, or even a tapered cross section.

In a first embodiment the first shank may have a cylindrical surface and/or the second shank may have a cylindrical surface.

In a second embodiment the first shank is tapered such that the first diameter increases in axial direction. Particularly, the first diameter increases corresponding to a temperature gradient in the first section.

Additionally or alternatively, the second section may be being a compressor section and the second shank may be tapered such that the second diameter increases in axial direction. The tapering may correspond to a temperature gradient in the second section. The axial direction may also be defined as corresponding to a downstream fluid flow of a working fluid through the second section during operation of the gas turbine engine.

Alternatively the second section may be a turbine section and the second shank may be tapered such that the second diameter decreases in axial direction. Again, the tapering may correspond to a temperature gradient in the second section. The axial direction may also be defined as corresponding to a downstream fluid flow of a working fluid through the second section during operation of the gas turbine engine.

Particularly, the first shank may have a conical surface and/or the second shank may have a conical surface. Alternatively the first shank may have a funnel shaped surface and/or the second shank may have a funnel shaped surface. With funnel shaped a form is meant for which the surfaces do not form a straight line in a cross section through the axis but showing section of a substantially concave curve. At the time of filing, an example of a funnel shaped body can be seen under http://mathworld.wolfram.com/Funnel.html.

Ignoring the possibly present shoulder between the shanks, a further embodiment may look like a pseudosphere as visualised under http://mathworld.wolfram.com/Pseudosphere-.html. This can be compared to two funnel shaped surfaces arranged opposite to each other.

As a further embodiment, the value of the second diameter may be substantially X times of the value of the first diameter, wherein X may be substantially 1.05 or 1.1 or 1.2 or 1.3 or 1.4, or 1.5.

When measuring the first diameter and the second diameter, average values for each shank may be compared. Also values at an axially middle position of the respective shank may be taken.

Besides, if both shanks will be having increasing diameters in downstream direction, than corresponding positions may be compared, like a diameter value after e.g. 20% of the length of the first shank taken from an upstream end of the first shank will be compared to a value a diameter value after 20% —identical to the measuring position of the first shank— of the length of the second shank taken from an upstream end of the second shank.

If the first shank will be having increasing diameter in downstream direction and the second shank decreasing diameter in downstream direction, then again corresponding positions may be compared, like a diameter value after e.g. 20% of the length of the first shank taken from an upstream end of the first shank will be compared to a value a diameter value after 20%—identical to the measuring position of the first shank— of the length of the second shank taken from a downstream end of the second shank.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematical. It is noted that for similar or identical elements in different figures, the same reference signs will be used.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation.

DETAILED DESCRIPTION OF THE INVENTION

All figures show schematically parts of a rotor of gas turbine engine in a longitudinal section along an axis A of rotation. The rotor will be arranged rotatably about the axis A of rotation. Stator parts are not shown in the figures. Also elements to interlock rotor parts may also not be shown in the figures. All figures depict rotor parts in an orientation that on the left there would be an inlet and on the right there would be an outlet of a specific area with a fluid flow through a main fluid path of the gas turbine from left to right.

All rotor parts shown in the figures may be substantially rotational symmetric in respect to the axis A of rotation.

Figure 1A:
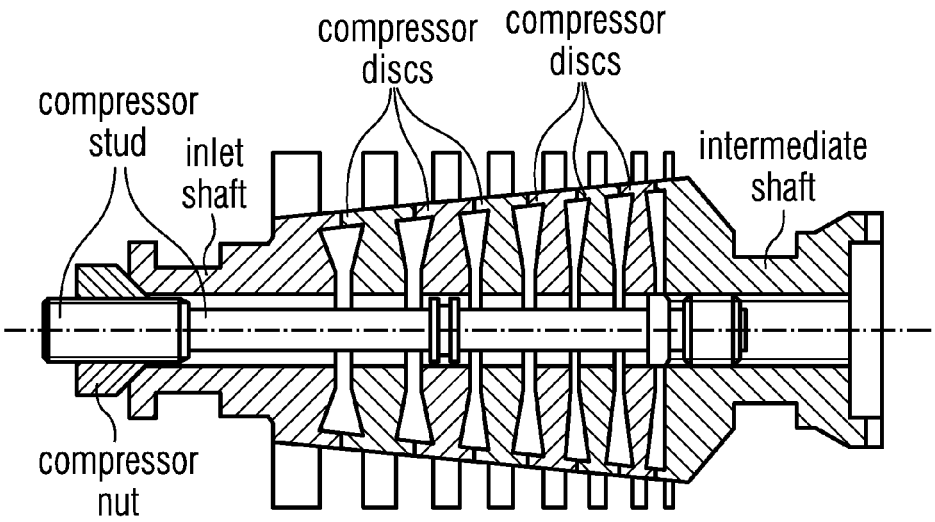
FIG 1A PRIOR ART
FIG. 1A: is a prior art figure and shows schematically a gas turbine during assembly after assembly of compressor discs via a first tension stud and a first nut.
Figure 1B:
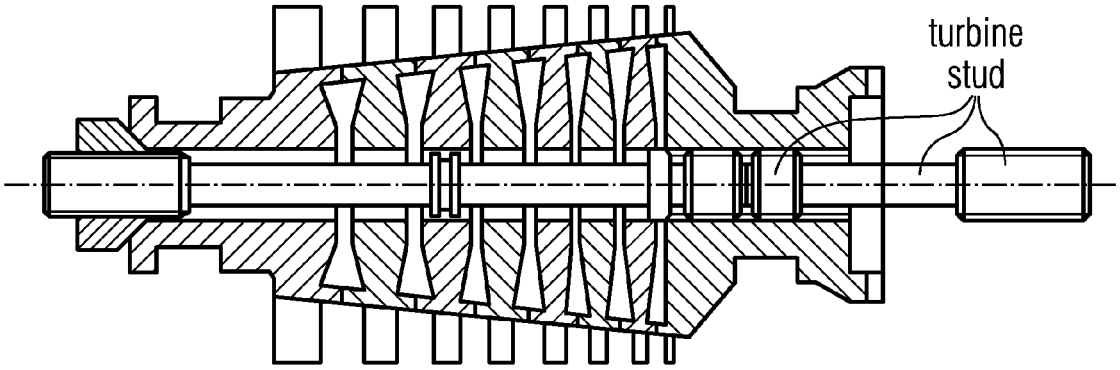
FIG 1B PRIOR ART
FIG. 1B: is a prior art figure and shows schematically a gas turbine during assembly after providing a second tension stud for the turbine discs.
Figure 1C:
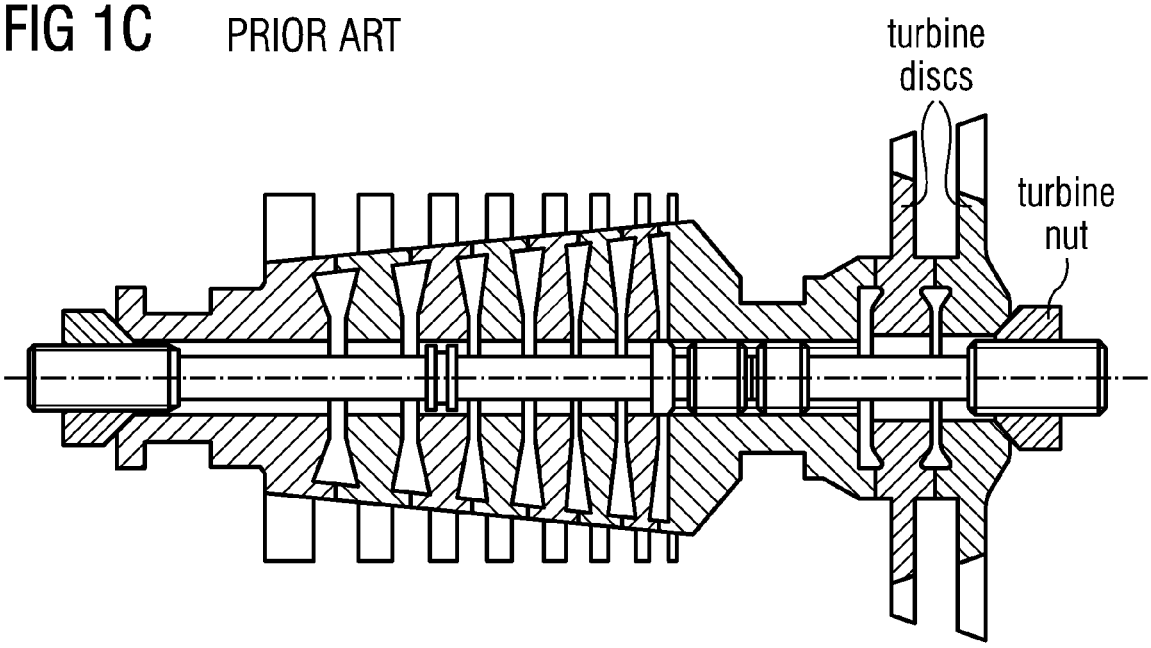
FIG 1C PRIOR ART
FIG. 1C: is a prior art figure and shows schematically a gas turbine during assembly after assembly of turbine discs via the second tension stud and a second nut.

FIG. 1 was already discussed in the introductory section and show a prior art configuration of a gas turbine engine and how the rotor will be assembled.

Figure 2:
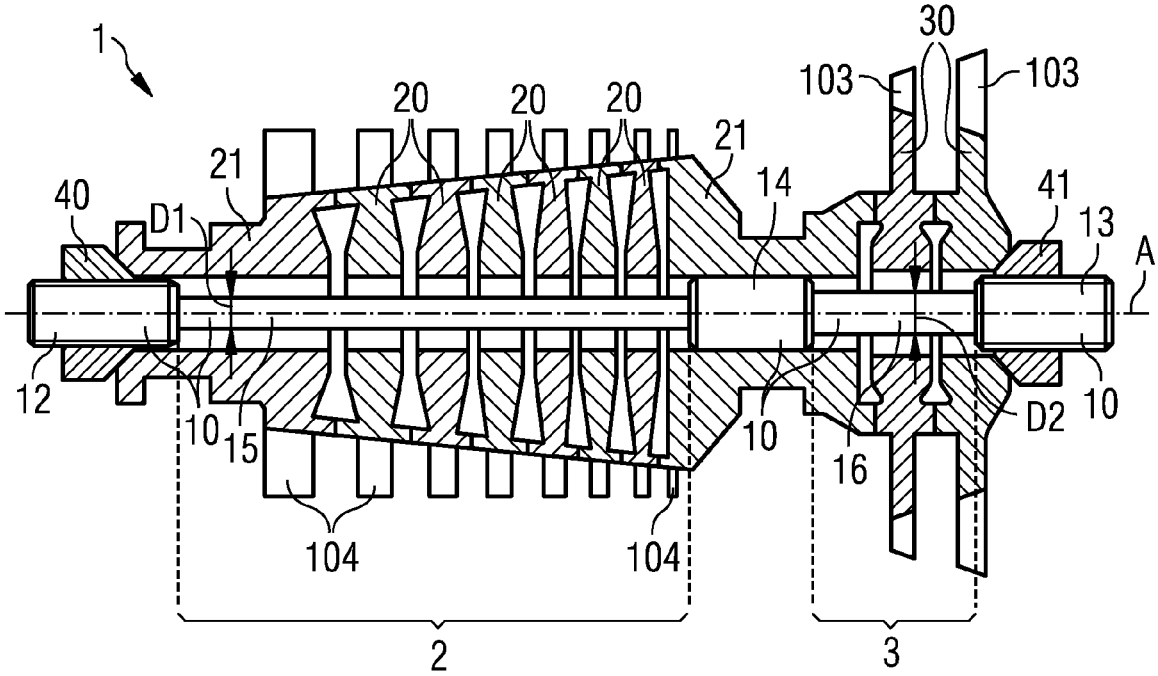
FIG. 2: shows schematically a gas turbine arrangement according to the invention with a single tension stud.

In FIG. 2 a part of a gas turbine engine 1 is schematically shown in a cross sectional view with a cross section through an axis A, particularly rotating elements within a compressor section as a first section 2 and within a turbine section as a second section 3, and an intermediate shaft element 21 to interconnect a first set of rotating elements of the compressor section—compressor discs 20—and the turbine section—turbine discs 30. No stator parts are shown, like a casing, guide vanes, mounting brackets, bearings, etc. Also a fluid inlet, combustion chambers, an exhaust and all kind of transitional pieces for the main fluid path are not shown. Even though the main fluid path is not indicated, parts of it can be perceived due to the presence of compressor blades 104 and turbine blades 103 shown as abstract blade aerofoils and due to the orientation of a radial outward ends of compressor and/or turbine discs 20, 30 that are visualised as blade platforms delimiting the main fluid path radially inwards. It has to be appreciated that this is highly abstract and a blade platform may be cast as one piece together with the blade aerofoils and inserted as one piece into a compressor or turbine disc 20, 30.

More important is the fact that the main fluid may be compressed along the fluid path in the compressor, which also has an effect on the temperature of the fluid. Fluid near the inlet of the compressor will have a lesser temperature than near the outlet of the compressor. This temperature gradient in the main fluid path may have an effect on the temperatures of the compressor discs and the tension stud present in that region. The tension stud may also have a temperature gradient along axial direction.

In the combustion chamber (not shown) a fluid and air mixture will be ignited resulting in a hot fluid which will be guided to the turbine section. Thus, there will be a temperature gradient between the compressor section and the turbine section, within the main fluid path but also affecting the discs and the tension stud.

Furthermore, within the turbine section the hot fluid will cool along the flow direction. Therefore again a temperature gradient will occur that also has an effect on the turbine discs and the tension stud. In this case higher temperatures will be present near the inlet of the turbine and lower temperatures will be present near the outlet of the turbine section.

In FIG. 2, a fully assembled rotor of a gas turbine engine 1 is shown.

In the axial centre of the gas turbine engine 1 a tension stud is present, around which revolvable shaft elements 21, revolvable compressor discs 20 and revolvable turbine discs 30 are positioned. All of the shaft elements 21 and discs 20, 30 may be interlocked axially between axially adjacent rotating parts—e.g. via set of corresponding teeth in the shaft elements 21 and the discs 20—and tension is applied to clamp together all these rotating parts via a first pre-load nut 40 applied to a first external end 12 of the tension stud 10 and via a second pre-load nut 41 applied to a second external end 13 of the tension stud 10. The first external end 12 and the second external end 13 of the tension stud 10 may be arranged with an outside or male thread and the pre-load nuts 40, 41 with an internal or female thread, each matching the thread of the respective first and second external ends 12, 13.

In the FIG. 2, the revolvable compressor discs 20 are shown with radially extending compressor blades 104 and the revolvable turbine discs 30 are shown with radially extending turbine blades 103.

The tension stud 10 comprises starting from the first external end 12 and proceeding in axial direction the first external end 12, a first shank 15, a shoulder 14 that provides support to a shaft 21, a second shank 16 and the second external end 13.

The shanks 15, 16 may be rotational symmetric parts that have a lesser radial extension than the external ends 12, 13 and the shoulder 14. According to FIG. 2, the shanks 15, 16 may be of cylindrical form, the first shank 15 having a first diameter D1 in radial direction which is substantially identical over the axial length of the first shank 15. The second shank 16 having a second diameter D2 in radial direction which is substantially identical over the axial length of the second shank 16.

In this embodiment the first shank 15 has a cylindrical surface. Furthermore also the second shank 16 has a cylindrical surface.

It does not mean that both shanks have to be cylindrical or both shanks have to be tapered. This freely can be combined so that features from the different embodiments can also be combined.

According to the invention, the first diameter D1 is less than the second diameter D2. Therefore less material may be used in a first axial section of the first shank 15 than in a second axial section of the same length as the first axial section of the second shank 16.

The shoulder 14 may be threadless to simply provide an opposing surface to the shaft 21. Alternatively the shoulder 14 may comprise an outside thread and the shaft 21 an inside thread such that the shoulder 14 may be screwed in the shaft 21.

Once all mentioned rotating parts—the discs 20, 30 and the shafts 21—are assembled the first and or the second pre-load nuts 40, 41 are used to apply tension on these parts in axial direction such that these parts get clamped together. To have this effect, the first and/or the second pre-load nuts 40, 41 may have an outer conical surface as shown in the figure which matches a surface of an opposing shaft—the shaft 21 in FIG. 2 on the left—or an opposing disc—the disc 30 in FIG. 2 on the right—such that the respective pre-load nut 40, 41 can generate, when tightened, an axial force such that all rotating parts are clamped together.

The tension stud 10 may only be in physical contact with the upstream shaft element 21, the other shaft element 21 and the most downstream turbine disc 30 and the pre-load nuts 40, 41. For the other discs 20 and 30 the inner diameter of the discs 20, 30 may be larger than the corresponding outer diameter of the shanks 15, 16 so that the discs will only be held in place by the interlocking means between the discs 20, 30 and shaft elements 21. The discs may have a central hole, big enough for the tension stud 10 to fit through for assembly.

It has to be appreciated that several alternative embodiments can be foreseen. For example only one pre-load nut may be present. Or the pre-load nuts may be of a different form. Also the distinction between shaft 21 and discs 20, 30 may not be always clear, as for example the shaft 21 in the centre in the figure also is equipped with compressor blades 104 and therefore could also be considered to be a compressor disc.

A main point of the inventive idea is directed to the form of the tension stud 10. In a first section 2—in FIG. 2 corresponding to a compressor section of the gas turbine engine 1—the first diameter D1 of the first shank 15 may be less than the second diameter D2 of the second shank 16 in a second section 3 which corresponds in FIG. 2 a turbine section of the gas turbine engine 1. During operation of the gas turbine engine 1, a fluid—for example air—will be compressed in the compressor section resulting in a temperature gradient with increasing temperatures from left to right, such that the temperature of the fluid increases. Then the fluid is guided to a combustor—not shown—, mixed with a fuel and ignited. Due to the ignition, the fuel and fluid mixture is heated and accelerated and guided to the turbine section of the gas turbine engine 1. Within the turbine section the hot fuel and fluid mixture is directed to the turbine blades 103 such that heat is transferred to the turbine blades 103 and to the turbine discs 30. This heat transfer may be supported by cooling means to cool hot surfaces and to guide away heat to a different area and to different parts. Consequently there will be a temperature gradient with decreasing temperatures from left to right within the turbine section.

Due to heat transfer via material of blades 104, 103 and discs 20, 30 and due to secondary fluid channels—not shown in the figures, e.g. to distribute cooling fluid taken from the main fluid path from the compressor section—also the tension stud 10 is indirectly affected by the heat of the fluid in the main fluid path such that an axial temperature gradient follows substantially the temperature gradient within the main fluid path.

Consequently, the temperature of the tension stud 10 in the region of the compressor section, thus in the region of the first shank 15, may be substantially less than the temperature of the tension stud 10 in the region of the turbine section, thus in the region of the second shank 16. Besides, there may be a slight temperature gradient with increasing temperature in axial direction of the first shank 15 and a slight temperature gradient with decreasing temperature in axial direction of the second shank 16.

According to FIG. 2, in the first section 2 the first diameter D1of the first shank 15 is less than the second diameter D2 of the second shank 16 in a second section 3. This accommodates to physical effects as explained in the following.

A tension stud or bolt is used in compressor and turbine sections of a gas turbine to clamp together a number of discs and shafts. The stud is stretched during assembly, and the amount of stretch must be sufficient to ensure adequate clamping load on the components at all operating conditions. The stretch required is affected by relative thermal and mechanical expansion and contraction of the stud and the clamped components. To achieve sufficient stretch, a large axial load is applied to the stud during assembly. This load varies through the operating cycle, and is reduced to zero when the compressor or turbine is disassembled. The stud is typically attached to a shaft or nut with a threaded connection. The axial load applied to the stud is transmitted through the threads, which have a significant stress concentration factor. The fatigue life of the stud may often limited by the threads. The inventive idea provides a means to achieve the required stretch with a reduced axial load, and an increased thread fatigue life. Particularly the invention takes advantage of the temperature gradient that exists down the length of the stud in axial direction. Using the same material over the length of the stud 10, the stud material will typically have higher strength at lower temperatures. According to the embodiment of FIG. 2 within the cooler sections of the stud 10—region 2—the first diameter D1 of the first shank 15 or bolt is reduced. Nevertheless the stud 10 and particularly the first shank 15 still have sufficient strength for fault conditions. The bolt diameter in hotter sections—the second diameter D2 of second shank 16—is larger because the strength of the material is reduced at high temperatures.

With "strength" also the fatigue life is meant, thus the ability of the stud to withstand repeated loading.

An advantage of the invention is that the required amount of stretch can be achieved on the tension stud or bolt with a reduced load. This is because the thinner section of the stud requires a smaller load to achieve the same amount of stretch i.e. a 10% reduction in cross sectional area will give the same stretch with a 10% lower load. This means that the maximum load transmitted through the stud threads is reduced, and the fatigue life of the threads is increased.

As a consequence, the stud 10 according to FIG. 2 allows to use less material in the first shank 15 than in a prior art stud.

Figure 3:
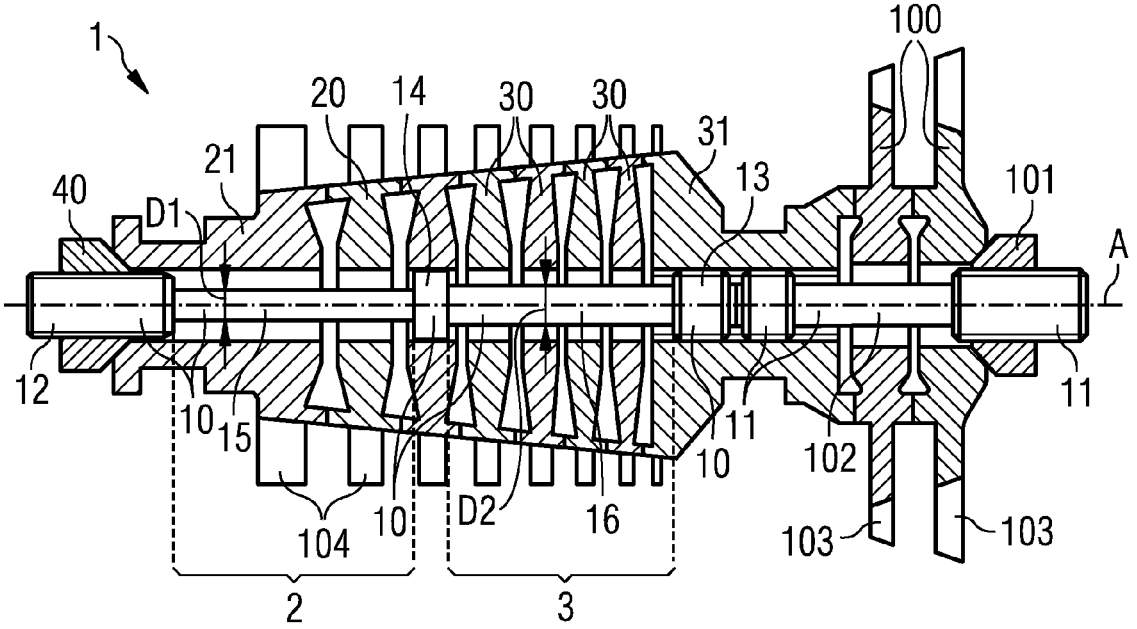
FIG. 3: shows schematically a gas turbine arrangement according to the invention with a two tension studs.

According to FIG. 3, two studs 10 and 11 are used with a gas turbine engine 1. This is similar to the example of FIG. 1. In this embodiment the to be discussed stud 10 with the two sections 2 and 3 is completely located within a compressor section of the gas turbine engine 1. The stud 10 may be inserted into a threaded shaft 31 which is in the region of the combustion chambers and provides a transition between the discs of the compressor and the discs of the turbine.

According to FIG. 3, a shaft 21 at an upstream end of the compressor, the shaft 21 also acting as a disc for supporting compressor blades 104, and a further downstream disc 20—also supporting further compressor blades 104—are located in a first region 2 of a first shank 15. The first shank 15 is followed in axial direction by a shoulder 14, a second shank 16, and finally a second external end 13, similar to FIG. 2. The axial expansion of the second shaft 16 is again identified as the second region 3.

Within the second region 3 further discs 30—compressor discs—are present, each holding further compressor blades 104. Following the discs 30 in axial direction a shaft 31 is located. According to FIG. 3 the shaft 31 acting as a compressor disc and being equipped with further compressor blades 104. The shaft 31 is connected via a threaded connection with the second external end 13 of the stud 10.

Upstream of the first region 2 the stud 10 comprises a first external end 12 with an external thread, which allows to screw a threaded first pre-load nut 40 on the first external end 12 in downstream direction. In contrast to FIG. 2 no pre-load nut will be applied to the second external end 13, as the second external end 13 is connected via threads to the shaft 31.

According to FIG. 3, a further stud 11 is provided for a turbine section. According to this embodiment the further stud 11 will only have one turbine shank 102, similar to FIG. 1C, but possibly the further stud 11 may also be arranged as the stud 10 in the compressor section with two shanks and an intermediate shoulder.

According to this embodiment, a first diameter D1 of the first shank 15 is less than a second diameter D2 of the second shank 16. The difference in diameters may be less than in the previous embodiment according to FIG. 2 because the temperature difference between the two regions 2, 3—both within the compressor section—is clearly less than the temperature difference between the compressor section and the turbine section, as in FIG. 2. Nevertheless, according the invention the first diameter D1 of the first shank 15 can be less than the second diameter D2. Still the same benefits can be gained, i.e. less material is used for the first shank 15. Therefore a required stretch can be achieved on the stud with a reduced load.

According to the previous embodiments, the shanks 15, 16 are in form of a cylinder. Alternatively, the stud could have several different diameters, or even a tapered cross section.

According to FIG. 4 only the studs are shown from a radial side view without the to be rotated parts surrounding the stud. FIG. 4 is directed to shanks having a tapered form.

Figure 4A:
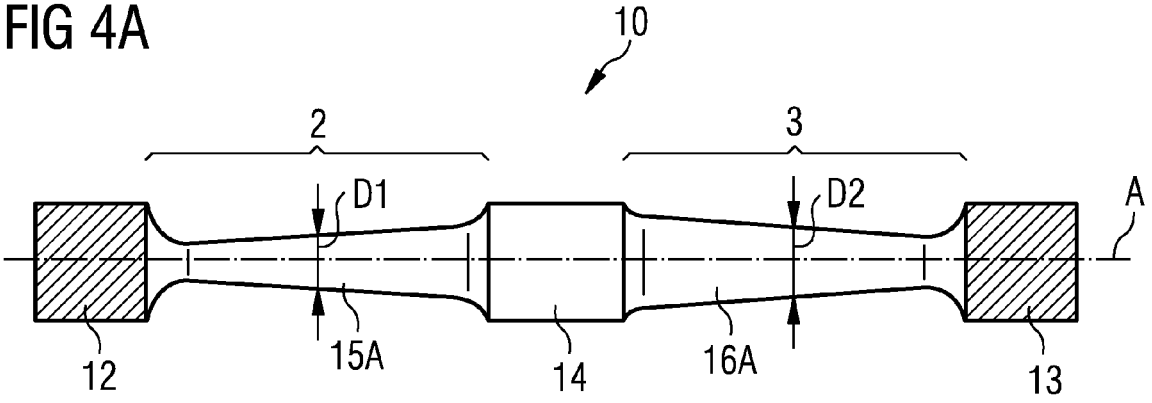
FIGS. 4A and 4B: illustrates tension studs with tapered bolts.

A stud 10 according to FIG. 4A can be used for a gas turbine as shown in FIG. 2, such that a first shank 15A is located in a compressor section—first section 2—and a second shank 16A is located in a turbine section—second section 3.

According to the temperature gradient the shanks 15A, 15B are tapered, e.g. in a conical shape, such that the first diameter D1 increases in downstream direction and the second diameter D2 increases in downstream direction. The diameter of D1 may be less than the diameter D2, if measured at a corresponding position, e.g. both taken in the middle of each shank 15A, 16A or both taken at a position near the first external end 12 or the second external end 13. Also average values can be calculated for the diameters. In this case an average first diameter D1 may be less than an average second diameter D2.

With this implementation of a stud 10 the form of the stud 10 can be adapted to the temperature gradient within the operating gas turbine.

Figure 4B:
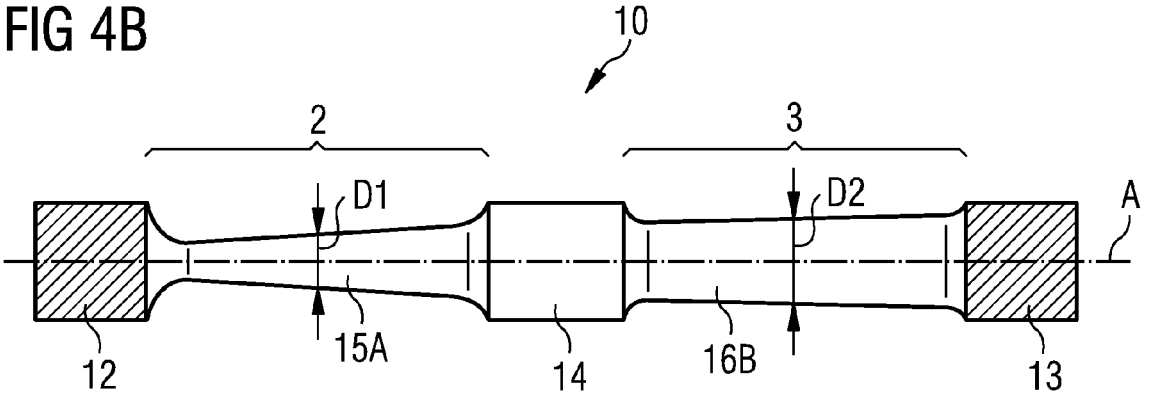

FIG. 4B shows a configuration that could be applied to a gas turbine according to FIG. 3, in which both sections 2 and 3 are located in a compressor section. Therefore a first shank 15A will have an increasing diameter in downstream direction and also a second shank 16B will have an increasing diameter, both following the temperature gradient in the compressor section. Again, the diameter of D1 may be less than the diameter D2, if measured at a corresponding position, e.g. both taken in the middle of each shank 15A, 16B or both taken at a most upstream position or both taken at a most downstream position. Also average values can be calculated for the diameters. In this case an average first diameter D1 may be less than an average second diameter D2.

In FIG. 4 a further detail is shown, that could also be implemented in the studs according to FIGS. 2 and 3. The stud 10 according to FIG. 4 has no abrupt ledges between the external end 12 (or 13) and the shank 15A (or 16A/16B) or between the shoulder 14 and the shanks 15A or 16A/16B. A transition piece is shown as a tapered section so that no points of stress are created.

Figure 5:
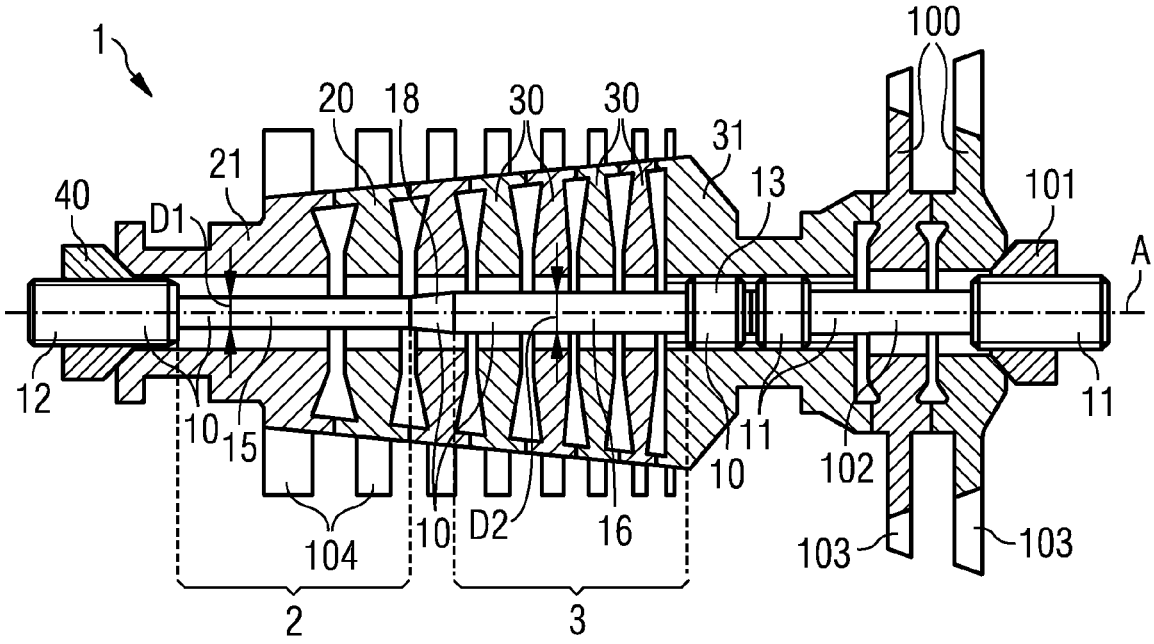
FIG. 5: shows schematically a gas turbine arrangement according to the invention with a two tension studs without a shoulder in between shanks of the stud.

FIG. 5 shows a similar gas turbine engine as FIG. 3, with the difference that the shoulder 14 is replaced by an intermediate section 18. The intermediate section 18 does not touch the discs 20, 30 or the shafts 21, 31. It merely provides a transition from the first shank 15 to the second shank 16. According to FIG. 5 the intermediate section 18 is of conical shape such that it adapts to the difference in diameter between the first diameter D1 and the second diameter D2.

The intermediate section 18 can have a variety of forms. It can be conical, it can be funnel shaped. Besides, there may be a smooth transition between the two diameters.

Alternatively to the previous figures, also several shoulders can be present for the tension stud.

As a summary, the invention takes advantage of the temperature gradient on the surface of the stud down the length of the stud during operation of the gas turbine engine. The stud diameter in hotter sections will be larger than in cooler section. This allows to gain a strength to withstand the loads that may occur during a fault condition, such as loss of one or more aerofoils or blades, even though the diameter of the stud may be less than in a prior art stud. Such a prior art tension stud may have a constant shank diameter except for local thickened areas to locate on the disc bores and larger diameter threads at the ends.

The invention may be applied to different kind of axial turbomachines or other kind of rotating machines that experience a temperature gradient along its axis of rotation.

The invention claimed is:

1. A gas turbine engine comprising:

a rotor rotatably mounted in a body about an axis, an axial direction being defined along the axis in downstream direction of a main fluid path, the rotor comprising:

a stud;

a first set of rotating elements of a first section of the gas turbine engine, the first section being a compressor section of the gas turbine engine;

a second set of rotating elements of a second section of the gas turbine engine, the second section being a turbine section and/or a further compressor section, the first and second set of rotating elements being discs and/or shafts, the stud extending along the axis and comprising:

a first external end and a second external end, the first external end adapted to engage a first pre-load nut or one of the shafts and the second external end adapted to engage a second pre-load nut or one of the shafts such that the set of rotating elements are secured, a first shank connected to the first external end, and a second shank connected to the second external end, wherein the first shank being located in the first section and having a first diameter, wherein the second shank being located in the second section and having a second diameter which is greater than the first diameter, wherein at least one of the first shank and the second shank has a conical surface.

2. The gas turbine engine according to claim 1, wherein the first shank being tapered such that the first diameter increases in axial direction, the first shank is tapered such that the first diameter increases in the axial direction corresponding to a temperature gradient in the first section.

3. The gas turbine engine according to claim 1, wherein the second section being a compressor section, and wherein the second shank being tapered such that the second diameter increases in axial direction, the second shank being tapered such that the second diameter corresponds to a temperature gradient in the second section.

4. The gas turbine engine according to claim 1, wherein the second section being a turbine section, and wherein the second shank being tapered such that the second diameter decreases in axial direction, the second shank being tapered such that the second diameter corresponds to a temperature gradient in the second section.

5. The gas turbine engine according to claim 1, the stud further comprising a shoulder such that the first shank is located between the first external end and the shoulder and the second shank is located between the shoulder and the second external end.

6. The gas turbine engine according to claim 1, wherein the value of the second diameter is substantially 1.1 times of the value of the first diameter.

7. The gas turbine engine according to claim 1, wherein the value of the second diameter is substantially 1.2 times of the value of the first diameter.

8. The gas turbine engine according to claim 1, wherein the value of the second diameter is substantially 1.3 times of the value of the first diameter.

9. The gas turbine engine according to claim 1, wherein the value of the second diameter is substantially 1.4 times of the value of the first diameter.

* * * * *